US005502266A

United States Patent [19]

Hodson

[11] Patent Number: 5,502,266

[45] Date of Patent: Mar. 26, 1996

[54] METHOD OF SEPARATING WELL FLUIDS PRODUCED FROM A GAS CONDENSATE RESERVOIR

[75] Inventor: John E. Hodson, Reading, England

[73] Assignee: Chevron Research and Technology Company, a Division of Chevron U.S.A. Inc., San Francisco, Calif.

[21] Appl. No.: 963,143

[22] Filed: Oct. 19, 1992

[51] Int. Cl.[6] ..... C07C 7/00; C07C 7/09

[52] U.S. Cl. ..... 585/802; 585/15; 585/899

[58] Field of Search ..... 585/15, 802, 812, 585/899

[56] References Cited

U.S. PATENT DOCUMENTS 3,159,473 8/1964 Meyers et al. ..... 62/12

3,303,232 2/1967 Pemy ..... 585/15

3,354,663 11/1967 Hendrix ..... 62/12

*Primary Examiner*—Ponnathapura Achutamurthy

*Attorney, Agent, or Firm*—M. W. Carson

[57] ABSTRACT

The present invention deals with separating well fluids produced from a gas condensate reservoir into a condensate phase and a gas phase. The invention provides combining two stage separation, a stabilizer column and gas processing systems to achieve increased liquid yield and dry gas for take off (export) with much lower energy costs and capital costs. First stage separation pressure is maintained between 600 psi and 1500 psi. Second stage separation pressure is maintained at a higher pressure than that required to achieve the liquid vapor pressure specification, usually between 400 psig and 600 psig. The stabilizing column produces a stabilized liquid (preferably having a vapor pressure about 8.2 psia at 80° F.) by operating the column bottom at approximately 240° F./50 psig.

4 Claims, 1 Drawing Sheet

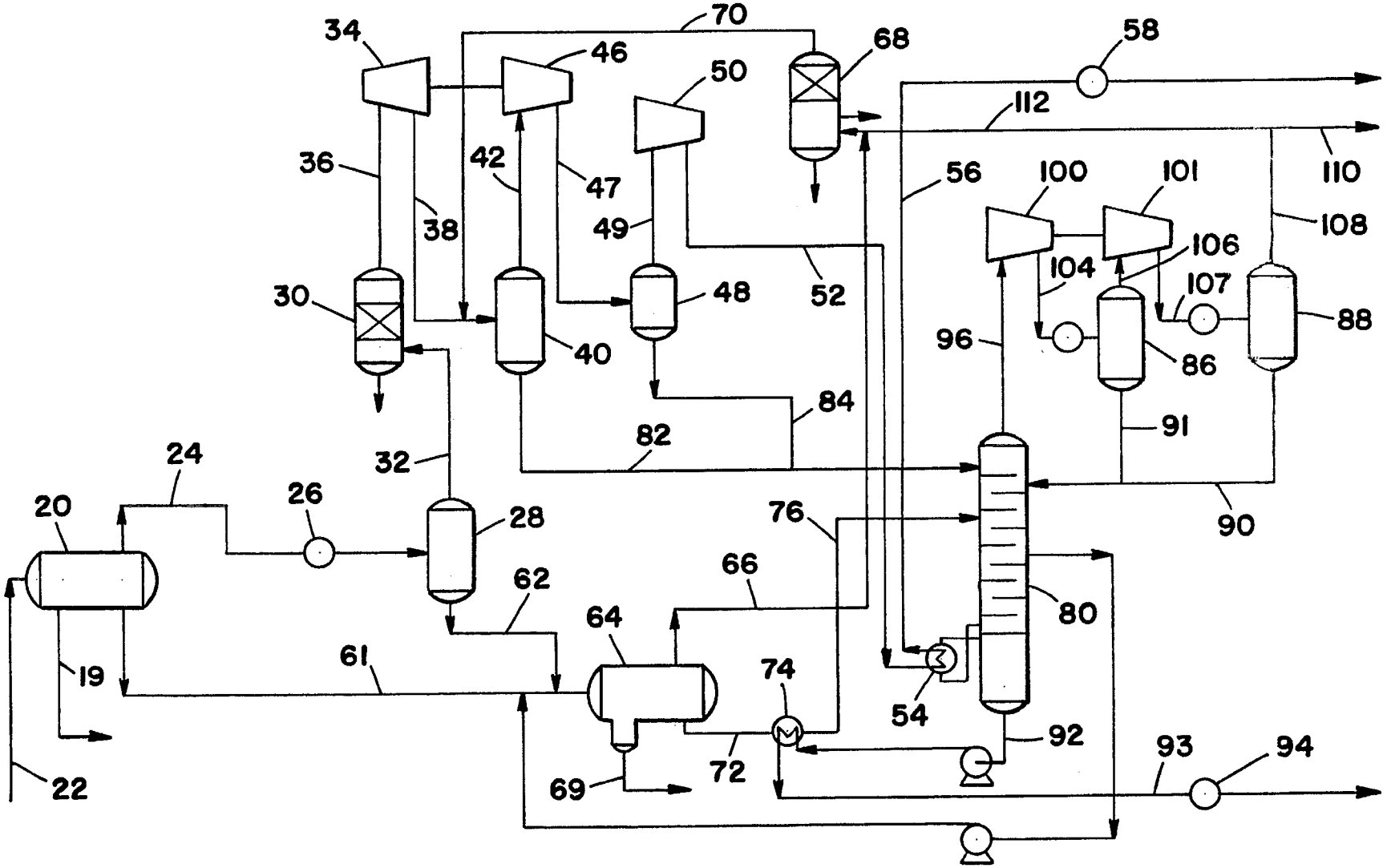
110
108
88
90
94
106
107
86
101
91
93
58
100
104
80
92
112
96
56
54
68
52
84
76
74
70
50
48
66
72
82
64
69
46
47
49
40
62
42
28
38
32
34
36
30
61
26
24
20
19
22

METHOD OF SEPARATING WELL FLUIDS PRODUCED FROM A GAS CONDENSATE RESERVOIR

FIELD OF THE INVENTION

The present invention relates to separating well fluids produced from a gas condensate reservoir. More particularly, the invention deals with separating produced fluids into components of gas and oil suitable for transfer from an offshore platform for further use.

SUMMARY OF THE INVENTION

The present invention provides a method of separating well fluids produced from a gas condensate reservoir into a liquid phase and a gas phase for export from an offshore platform. The gas condensate produced fluids from a reservoir are flowed to a first stage separator. The first stage separator is maintained at a pressure of between 600 psig and 1200 psig, while the separation temperature is maintained between the hydrate formation temperature of the produced fluids and about 240° F. The produced fluids are then separated into a first gas phase and a first liquid phase, with the first gas phase being cooled to below about 80° F., wherein residual liquid is removed from the first gas phase and combined with the first liquid phase. The first gas phase is dehydrated to remove additional residual liquid and then compressed and flowed to an export system. The first liquid phase, having been combined with the residual liquid removed from the first gas phase, is flowed to a second stage separator maintained at a pressure of about 400 psig and about 600 psig and a temperature of 80° F. to 200° F. The combined liquid is then separated into a second gas phase and a second liquid phase. The second gas phase is dehydrated and sent to an export system, while the second liquid phase is heated and flowed to a stabilizer column maintained at a pressure between about 15 psig and about 50 psig and a temperature between and about 50° F. at the top of said column to 240° F. at the bottom. Liquid is then removed from the stabilizer column to an export system and gas is removed from the stabilizer column to an export position.

The present invention provides a system for separating well fluids produced from a gas condensate reservoir into a condensate phase and a gas phase, and includes a first stage separator having a gas outlet and a condensate outlet for making an initial separation of condensate and gas. A gas cooler is provided, as well as a conduit means connecting the gas outlet of the first stage separator with the gas cooler. A gas knockout drum having an fluid inlet, a gas outlet, and a condensate outlet is operably connected with the gas cooler. Connected to the gas outlet of the gas knockout drum is a glycol contactor for removing water from gas having a turbo expander operably connected thereto. Attached to the turbo expander is a gas export compressor and a dew point separator. A stabilizer reboiler and a gas export cooler are operably connected to the gas export compressor. A second stage separator of lower pressure is provided having a fluid inlet, a gas outlet and a condensate outlet, where a conduit means connect the condensate outlet of the first stage separator with the fluid inlet of the low pressure second separator. Conduit means also connect the gas outlet of the second stage separator and the dew point separator for flowing gas thereto. A stabilizer column having a fluid inlet, a gas outlet, a condensate outlet and an intermediate outlet is also provided. A condensate heater is connected to the condensate outlet of the second stage separator to the inlet of the stabilizer column. A condensate export pump, a condensate heater, and a condensate export cooler are connected to the condensate outlet of the stabilizer column for condensate export. A water draw pump is connected to the intermediate outlet of the stabilizer column to the inlet of the low pressure separator. Conduit means are used to connect the gas outlet of the stabilizer column through the expansion-compression means to a position for fuel gas use.

BRIEF DESCRIPTION OF THE DRAWING

The drawing is a process flow diagram illustrating in diagram form an assembly of apparatus useful in the preferred embodiment of the invention.

DETAILED DESCRIPTION OF THE INVENTION

Basically, the present invention deals with separating well fluids produced from a gas condensate reservoir into a condensate phase and a gas phase. The method of the invention provides combining two stage separation, a stabilizer column and gas processing systems to achieve increased liquid yield and dry gas for take off (export) with much lower energy costs and capital costs.

The first stage separation pressure is maintained between 600 psi and 1500 psi and preferably between 800 psi and about 1000 psi, to enable dehydration, expander-recompression and export processing through the single stage export compressor to be the main gas process steps.

The second stage separation pressure is maintained at a higher pressure than that required to achieve the liquid vapor pressure specification. This is usually between 400 psig and 600 psig, wherein the gas is recovered via a small gas drier to a dew point separator. However, recovery of liquid from the second stage separation can be increased by operating at this higher pressure.

The stabilizing column of the stabilizing section produces a stabilized liquid (preferably having a vapor pressure about 8.2 psia at 80° F.) by operating the column bottom at approximately 240° F./50 psig. The vapor leaving the upper portion of the column is compressed to about 500 psig and cooled to about 80° F., with the liquid being refluxed back to the column and the gas either exported for fuel or recycled to an expander turbine for recovery.

The main features of the stabilizer section include:

- heat integration with the export compression stage for reboiler heat;
- the liquid reflux can either be returned to the column or used as liquid fuel allowing for greater operational flexibility;
- the gas from the column overhead can be used as fuel gas or sales product;
- the gas and liquid export specification can be varied by changing the temperature and pressure operating conditions of the stabilizer column;
- the quality of the second separator condensate/liquid varies through a field life, therefore the stabilizers and overhead compressor system can continue to achieve product specifications without modifications;
- the water is decanted from the stabilizer column, recycled back to the second separator, and then on to the hydrocyclones; and
- the high temperature in the base of the column will allow for a low water specification (less than 0.5% BS&W) to be achieved.

Thus the present invention provides a method of separating well fluids produced from a gas condensate reservoir into a liquid phase and a gas phase for export from an offshore platform, which includes flowing gas condensate produced fluids from a reservoir to a first stage separator, maintained at a pressure of between 600 psig and 1500 psig and a temperature between the hydrate formation temperature of the produced fluids and 240° F. The said gas condensate is separated into a first gas phase and a first liquid phase where the first gas phase is cooled to below about 80° F. and residual liquid is removed. The first gas phase is then dehydrated to remove additional residual liquid before expanding and cooling the first gas phase to a pressure and temperature needed to achieve the hydrocarbon dew point pressure desired for export. The first gas phase is then compressed and flowed to an export system. The first liquid phase, after initial separation from the first gas phase, is combined with the residual liquid removed from the first gas phase to form a combined liquid phase. The combined liquid phase is then flowed to a second stage separator maintained at a pressure of between about 400 psig to 600 psig and a temperature between 80° F. to 200° F., where the combined liquid is separated into a second gas phase and a second liquid phase. The second gas phase is dehydrated in the same manner as the first gas phase to remove additional residual liquid and is flowed to an export system. The second liquid phase is flowed to a stabilizer column maintained at a pressure of about 15 psig to 50 psig and a temperature between about 50° F. at the top of the column to 240° F. at the bottom. Liquid is removed from the stabilizer column and flowed to an export system, while gas is removed from the stabilizer, compressed and dehydrated for recycle into the first gas phase.

The preferred process of the present invention will be described in more detail with reference to the drawing. The first stage separation 20 receives production fluids via line 22 from the condensate wells which penetrate the producing formation. Typical condensate will be received into the system pressures ranging from 500 psi to 5000 psi and temperatures between ambient to 240° F. In the preferred embodiment of the invention, we are dealing with condensate being introduced into the system at about 1000 psi.

The first stage separator 20 in the preferred embodiment is operated between about 600 psi and 2000 psi with preferred range between 800 psi and 1200 psi at wellhead temperature, which is approximately 140° F. Water, sand and trace amounts of oil leave separator 20 via line 19 to hydrocyclones for separation. Gas leaving the first stage separator 20 via line 24 is cooled by gas cooler 26 to about 80° F. and separated from liquid in gas knockout drum 28. Gas from the knockout drum 28 is flowed to a dehydration tower 30 via line 32 thence to turbo expander 34 via line 36 where it is expanded to about 500 psi and cooled to about minus 14° F. The gas and liquid phases leave turbo expander 34 via line 38 to dew point separator 40. Gas leaving dew point separator 40 via line 42 is compressed in compressor 46 to a pressure of about 720 psia and a temperature of about 31° F. An advantage of the present system is the energy efficiency achieved by utilizing the power produced by turbo expander 34 as power for compressor 46. The final traces of liquid from the fluid leaving compressor 46 via line 47 are removed from the gas in a compression suction scrubber 48. Gas from suction scrubber 48 flows via line 49 to gas export compressor 50 to a desirable pressure for the system export system; for example, 2500 psi.

The hot gas flows via line 52 and through reboiler 54 and is used to heat stabilizer column 80, and then returns via line 56 through cooler 58 for export.

The hydrocarbon liquids from first stage separator 20 via line 61 are mixed with liquids from the gas knockout drum 28 via line 62 and thence to the second stage separator 64. The second stage separator 64 is operated at a pressure of about 500 psia and at a temperature of approximately 140° F. Gas leaving the second stage separator 64 via line 66 is flowed to a gas recycle drier 68 and then via line 70 to line 38 and dew point separator where it is cooled by mixing with the turbo expander gas.

The high operating pressures of second stage separator 64 allow the sand, water and trace amounts of oil which are removed from the second stage separator 64 via line 69 to drive hydrocyclones, not shown, for separation. Hydrocarbon liquid from the second stage separator 64 via line 72 is heated by condensate heater 74 and fed via line 76 to the middle of a stabilizer column 80 as a two phase mixture.

The stabilizer column 80 is operated at about 15 psig to 50 psig, where the base temperature of the column 80 is maintained at about 240° F. and the top at about 50° F. Additional liquid feeds to the stabilizer column 80 are condensate from the expander turbine liquid separator 40 via line 82 and compression suction scrubber 48 via line 84 along with condensate liquids from the stabilizer overhead compressor separators 86 and 88 via lines 90 and 91. An important feature of the present invention is its utilization of high pressure at a constant temperature to develop a higher liquid yield; thereby preventing heavy, higher molecular weight material from going into the gas phase to ultimately yield a drier gas. This feature, which allows the present system to be fine tuned to a higher yield specification, also allows water to be extracted from stabilizer column 80 at 114, making unnecessary an additional separation and heating step as generally found in the prior art.

The liquid exports from the stabilizer column 80 are the condensate from the base of the column via line 92 for cooling in condensate cooler 74, then to the export cooler 94 via line 93. The vapor overheads from stabilizer column 80 via line 96 are compressed to about 550 psia in a two stage compressor 100, 101. Residual liquid leaves compressor 100 via line 104 to knockout drum 86, with fluid leaving the knockout drum 86 via line 106 being compressed in compressor 101 and then flowed to knockout drum 88 via line 107. Gas is flowed from knockout drum 88 via line 108 and line 110 for use as fuel gas or alternatively via lines 108 and 112 for recycling to the gas recycle drier 68. Water is removed from the gas in recycle drier 68 and flowed via line 70 to the dew point separator 40.

The process of the present invention is flexible in adapting to changing conditions and demands. For example, the pressure, temperatures, liquid rate and vapor rate of the stabilizer column 80 can be changed to vary the gas sales and liquid sales product specifications. Additionally, the second stage separator and stabilizer column conditions can be changed to maintain product specifications as the reservoir fluid analysis changes during field life; while the stabilizer reflux liquid can be used as a second liquid product or an alternative gas turbine fuel. As the pressure and flow rate from the reservoir declines, changing the reservoir fluid quality, the compressors and expander turbine can be adjusted to maintain the process conditions and requirements. A further advantage of the present invention is that the system's pressure in recycle drier 68 and knockout drum 88, as well as the pressure in line 66 out of separator 64 are all equal; thereby allowing all gas in the system to be combined at dew point separator 40. This enables the present system to utilize only one major area of compression, at export compressor 50, thereby requiring only a single point for every input.

DESIGN EXAMPLE

For a production rate of 700 million stock cubic feet per day (MMCFD) of separated gas up to 395 MMSCFD is assumed to be produced from a group of 22 platform wells and the remaining 305 MMSCFD from satellite wells. The first stage separator operates at 69 bara at which pressure the following temperature of the platform wells is 76° C. Fluids from the satellite wells are assumed to arrive at 38° C. due to cooling in the in-field lines and risers. The combined operating temperature of the first stage separator is thus 60° C. There is no advantage in preheating the well fluids, as this merely increased the separated gas cooler duty unnecessarily.

From the inlet manifold, the well fluids are split into two identical process trains. Each train has a second stage inlet separator which is sized as a three phase separator. Separated gas is released under pressure control and cooled to 34° C. in the separated gas cooler by seawater.

Condensate from this cooler is removed in the separated gas knockout drum and the gas passes on to the glycol contractor where water is absorbed by 99.6 wt. % triethylene glycol. From the glycol contractor, the gas is let down under pressure control through the turbo expander to the dew point separator at 31 bara. An assumed isotropic efficiency of 75% produces a temperature of minus 10° C. which yields a considerable amount of condensate and produces a gas with a cricondontherm at minus 5° C., which easily meets the dew point specification of 5° C. at 96 bara. The dew pointed gas is compressed to 49 bara by the recompressor and is then further compressed to an export pressure of 172 bara by the gas turbine driven, centrifugal gas export compressor. Pressure in the dew point separator is controlled by speed control of the gas export compressor.

Following compression, the high temperature export gas is used to reboil the condensate stabilizer column, and is then cooled by seawater in the export gas cooler. This cooler is sized as the compressor recycle cooler, and is capable of providing sufficient cooling for full recycle of the compressor at minimum flow. Turndown of the compressor is not a problem as gas is let out of the recycle loop under pressure control. The gas export temperature of 80° F. results from the appropriate sizing of the cooler.

Condensate recovered from the first stage inlet separator is let out under level control and mixes with condensate released from the first stage separated gas knockout drum.

The combined condensate stream flows to the three phase second stage separator at a pressure of 32 bara.

Vapor from this separator is fed back to the dew point separator via the gas recycle drier, while the condensate is let out under level control to the stabilizer column. The column feed is preheated in the condensate heater by the bottom product to a temperature sufficient to avoid hydrate or ice formation at the top of the column. The stabilizer has eight or more distillation trays depicted in column 80 as horizontal lines, and a total trap out tray; feed enters at tray 6 and a water draw is made immediately below on tray 5 as shown. Reflux is provided by condensate from the dew point separator, and on tray 8 from the stabilizer overheads compressor knockout drums. Reboil duty is provided by high temperature export gas in a once through reboiler. This sets the maximum achievable bottoms temperature of about 126° C., for a 5° C. approach, which in turn determines the stabilizer column pressure of 3.5 bara to meet the condensate vapor pressure specification of 0.9 bara at 60° C. To achieve the liquid export specification of 0.5655 bara at 27° C. requires only 112° C. bottoms temperature. For the same temperature approach, this is attainable with a gas export temperature of 132° C. and hence export gas pressures as low as 146 bara.

The stabilizer bottoms product is exported to a desired location via the condensate heater and condensate export cooler by the condensate export pumps. Overhead vapor from the stabilizer is compressed in a two stage centrifugal compressor. Condensed liquids are returned to the columns as reflux. The gas is fed back to the dew point separators via the common gas recycle drier or to fuel gas. Water from the stabilizer column is pumped back to the second stage separator where it is then sent to hydrocyclones for treatment, with water from the first stage separator also being sent to the hydrocyclones.

From the above description, it is evident that the present invention provides a process for separating the components of a production fluid stream from a gas condensate reservoir in an efficient manner. Although only specific embodiments of the present invention have been described in detail, the invention is not limited thereto but is meant to include all embodiments coming within the scope of the appended claims.

What is claimed is:

1. A method of separating well fluids produced from a gas condensate reservoir into a liquid phase and a gas phase for export from an offshore platform comprising:

flowing gas condensate produced fluids from a reservoir to a first stage separator;

maintaining the first stage separator at a pressure of between about 600 psi and 1500 psi and a temperature of between approximately the hydrate formation temperature of the produced fluids and 240° F.;

separating said gas condensate into a first gas phase and a first liquid phase, and cooling said first gas phase to below about 80° F.;

removing a residual liquid component from said first gas phase, and dehydrating said first gas phase to remove residual water from said first gas phase;

expanding and cooling said first gas phase to a pressure and a temperature needed to achieve a hydrocarbon dew point pressure that permits a substantially single phase flow;

compressing said first gas phase and flowing said first gas phase to an export system;

combining said first liquid phase with the residual liquid removed from said first gas phase, and flowing the combined liquid phase to a second stage separator maintained at a pressure of between about 400 psig to 600 psig and a temperature of about 80° F. to 200° F.;

separating said combined liquid into a second gas phase and a second liquid phase, dehydrating said second gas phase, and flowing said second gas phase to an export system;

flowing said second liquid phase to a stabilizer column maintained at a pressure of about 15 psig to 50 psig and a temperature between about 50° F. at the top of said column to 240° F. at the bottom of said column;

removing a liquid component from said stabilizer column to an export system and removing a gas component from said stabilizer; and compressing and dehydrating said gas component for recycle into said first gas phase.

2. A method of separating well fluids produced from a gas condensate reservoir into a liquid phase and a gas phase for export from an offshore platform comprising:

flowing gas condensate produced fluids from a reservoir to a first stage separator, maintaining the first stage separator at a pressure of between about 600 psi and 1500 psi and a temperature of between approximately the hydrate formation temperature of the produced fluids and 220° F.;

separating said gas condensate into a first gas phase and a first liquid phase of hydrocarbons and water, and cooling said first gas phase to below about 80° F.;

removing a residual liquid component from said first gas phase, and dehydrating said first gas phase to remove residual water from said first gas phase;

expanding and cooling said first gas phase to a pressure and a temperature needed to achieve a hydrocarbon dew point pressure that permits a substantially single phase flow;

compressing said first gas phase and flowing said first gas phase to an export system;

combining said first liquid phase with the residual liquid removed from said first gas phase, and flowing the combined liquid phase to a second stage separator maintained at a pressure of between about 400 psi to 600 psi and a temperature of about 80° F. to 140° F.;

separating said combined liquid into a second gas phase and a second liquid phase, dehydrating said second gas phase, and flowing said second gas phase to an export system;

heating said second liquid phase to a temperature between about 140° F. and 200° F., and flowing said second liquid phase to a stabilizer column maintained at a pressure of about 15 psi to 50 psi and a temperature between about 50° F. at the top of said column and 240° F. at the bottom of said column;

removing water from an intermediate location of said stabilizer column, removing liquid hydrocarbons from the lower portion of said stabilizer column to an export system, and removing gas from the top of said stabilizer column; compressing and dehydrating said gas for recycle into said first gas phase.

3. The method of claim 1 where the first stage separator is maintained at a pressure between about 800 psi and 1000 psi.

4. The method of claim 1 where the first stage separator is maintained at a pressure between about 800 psi and 1000 psi and the pressure of said second stage separator is about 500 psi.

* * * * *